United States Patent [19]

Lawrence et al.

[11] 4,154,534

[45] May 15, 1979

[54] TRANSIT CONCRETE MIXER ADAPTED FOR LOADING AND DISCHARGING AGGREGATES OF A WIDE RANGE OF SLUMP VALUE

[75] Inventors: William A. Lawrence; John A. O'Dea, both of Columbus, Ohio

[73] Assignee: The Jaeger Machine Company, Columbus, Ohio

[21] Appl. No.: 819,770

[22] Filed: Jul. 28, 1977

[51] Int. Cl.[2] ..... B28C 7/16

[52] U.S. Cl. ..... 366/42; 366/44; 366/59

[58] Field of Search ..... 366/27, 30, 41, 42, 366/44, 57, 59, 68, 135, 187, 188, 192, 193; 193/10, 15, 16

[56] References Cited

U.S. PATENT DOCUMENTS

| | | | |
|---|---|---|---|
| 2,902,268 | 9/1959 | Broberg | 366/41 |
| 2,904,318 | 9/1959 | Broberg | 366/41 |
| 3,038,705 | 6/1962 | McDermott | 366/44 |

*Primary Examiner*—Harvey C. Hornsby
*Assistant Examiner*—Timothy F. Simone
*Attorney, Agent, or Firm*—John A. Young

[57] ABSTRACT

A transit concrete mixer includes a drum which is mounted for discharge either forwardly or reversely of the vehicle and has two sets of flights for two-stage concrete loading and discharging. One set of flights is particularly useful for carrying the aggregate from the base of the drum upwardly along the major axis of the drum and a second set of flights is adapted for receiving the aggregate and transporting it through the remaining length of the drum to the discharge opening of the drum. Thus, for relatively stiff, low slump aggregates which are useful in paving and for formless type useage, the concrete mixer unit is fully adaptable for such low slump values. Conversely, the same set of flights is adapted for charging and discharging relatively high slump values which are utilized for form type applications. Additionally, the discharge opening of the drum is controlled in accordance with the slump of the discharging concrete mix or aggregate so that for relatively stiff and low order slump values the aggregate is dischargeable without impediment and, conversely, for more fluid, high slump aggregates, the discharge opening is controllable by an adjustably placeable weir which precludes too rapid emergence of the slump for given drum rotations with the described combination of flights. The transit mixer unit is, therefore, the first practicable all-purpose transit mixer.

8 Claims, 10 Drawing Figures

TRANSIT CONCRETE MIXER ADAPTED FOR LOADING AND DISCHARGING AGGREGATES OF A WIDE RANGE OF SLUMP VALUE

BACKGROUND OF THE INVENTION

Most concrete mixer units are adapted for handling either very low orders of slump in which the aggregate tends to be very stiff and has a low water content (such slumps being adapted for paving and for formless type pouring), or the transit mixer is adapted for relatively high slumps in which there is a more liquid type aggregate characterized by a high water content and in which the pour is generally made into a form. The difficulty lies in providing a single concrete mixer unit which can handle both orders of slumps. Heretofore the mixer has been particularly adapted for one or the other, but not for both. The obstacle to an all-purpose mixer lies in the inability of the bowl to effect a discharging action on stiff, low slump aggregates when the bowl is counterrotated to lift the aggregate from the interior of the bowl, from the base or lowermost bowl section and cause it to be lifted along the length of the bowl to the raised discharge end of the bowl. What happens is that if the bowl and unit are constructed to handle very stiff, low order magnitude slumps of aggregates, then when there is substituted a high slump, or fluid, mixture, the bowl, upon counterrotation, tends to effect too rapid discharge of such aggregate. Conversely, for drums which are adapted for very high slumps, the same drum, if loaded with a very low, stiff slump, is unable to discharge because the aggregate moves up the drum, then falls back, rather than emerging at the discharge end of the drum. Therefore, it is typical of the art that a transit concrete mixer unit, whether of the front discharge or rear discharge variety, is adapted for low or high slumps, but not for both.

SUMMARY OF THE INVENTION

It is one of the principal objects of the present invention to provide a transit concrete mixer which is adapted for receiving, mixing, and then discharging, aggregates of a variable slump value covering the entire range of very low slump adapted for pours in the manufacturing of pavement, curbing (where formless, continuous machines are adapted) and other such applications, and is equally adaptable for high slump aggregates having characteristically high water content and in which the pour is generally to make foundations where there are forms and the like.

An important feature of the present invention is that the same truck is made to have greater versatility and adaptability for a full range of mixtures so that it is, in effect, the first practicable, all-purpose transit concrete mixer unit.

Another object of the present invention is to provide a unique system of two-stage discharge for the aggregate within the bowl or mixer drum so that, with a given counterrotation of the drum, it is possible to wholly evacuate the interior of the drum during a pour. A related object is that the discharge opening from the drum is controllable in its effective cross section so that a weir is selectively placeable relatively to the drum to determine the effective cross section of the discharge opening and control the rate of discharge according to the slump value of the aggregate during the pour. Thus, the emergence rate of the aggregate is made a function of the drum rate of rotation, and the slump value, to meet the capacity of the associated devices to handle the given pour. Thus, in many machines which are now utilized in the continuous pouring of curbing where there is no form, the present transit mixer is intended to handle very low slump, stiff aggregate mixtures, and the drum rotation is adapted, together with the effective cross section of the discharge orifice of the drum to determine the rate of discharge appropriate to the operation or capacity of the machine receiving the pour as, for example, a machine continuously making curbing.

Other objects and features of the present invention will become apparent from a consideration of the following description which proceeds with reference to the accompanying drawings wherein certain selected example embodiments of the invention are illustrated by way of example.

DRAWINGS

DETAILED DESCRIPTION OF THE INVENTION

Figure 1:
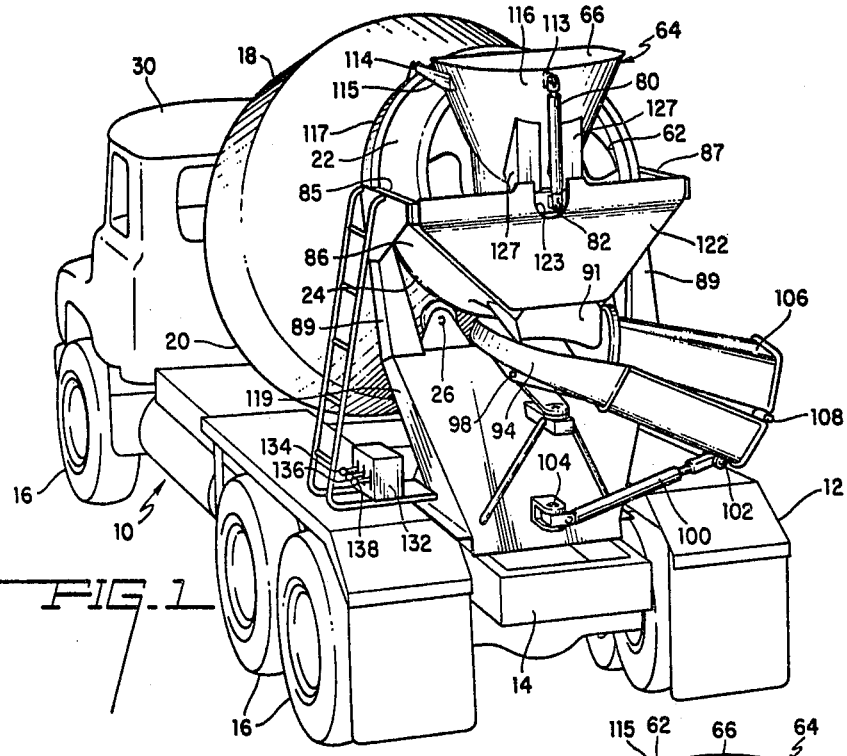
FIG. 1 is an isometric view of a rear discharge transit concrete mixer unit employing the invention therein.
Figure 2:
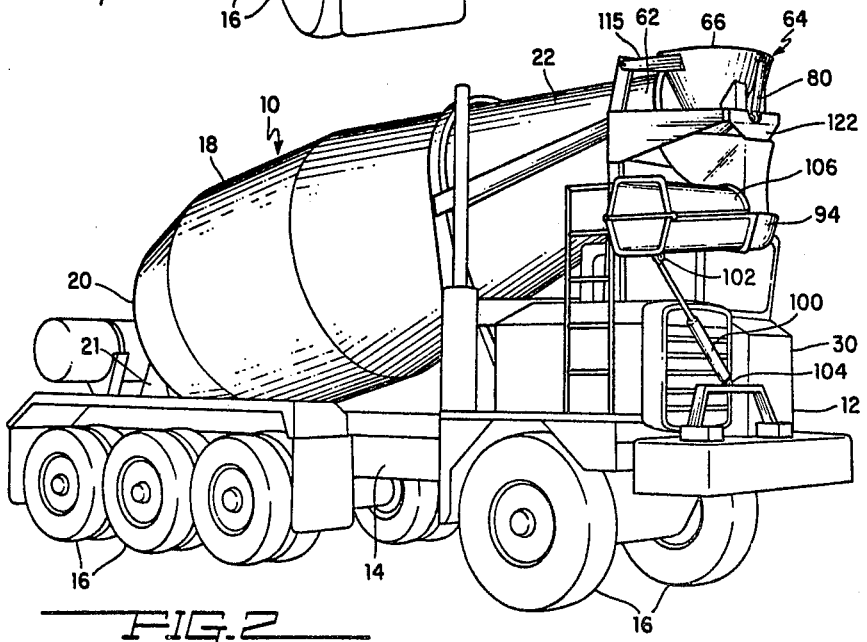
FIG. 2 is an isometric view of a front discharge concrete mixer unit illustrating how the invention is adapted for that application.

Referring now to the drawings, a transit concrete mixer unit designated generally by reference numeral 10, consists of a truck 12 having a frame 14 with ground-engaging sets of wheels 16. Mounted on the frame 14 and rotatable thereon, is a drum or bowl 18 which is mounted for either discharge to the rear of the truck as shown in FIG. 1, or discharge to the front of the truck, as illustrated in FIG. 2. The drum is mounted so that the base or lowermost section 20 has a bearing support 21 on frame 14. The upper drum end 22 is also supported on the frame 14 through a collar 24 or bearing ring and turnable on support bearings 26 (FIG. 1). The rotatable drum 18 is somewhat differently shaped for rear discharge and front discharge arrangements. As indicated in FIG. 2 the drum in the forward discharge end arrangement extends up and over the cab 30. The principle of the invention, however, is the same in the two different embodiments. The present invention has the ability to adapt to either discharge method.

Figure 9:
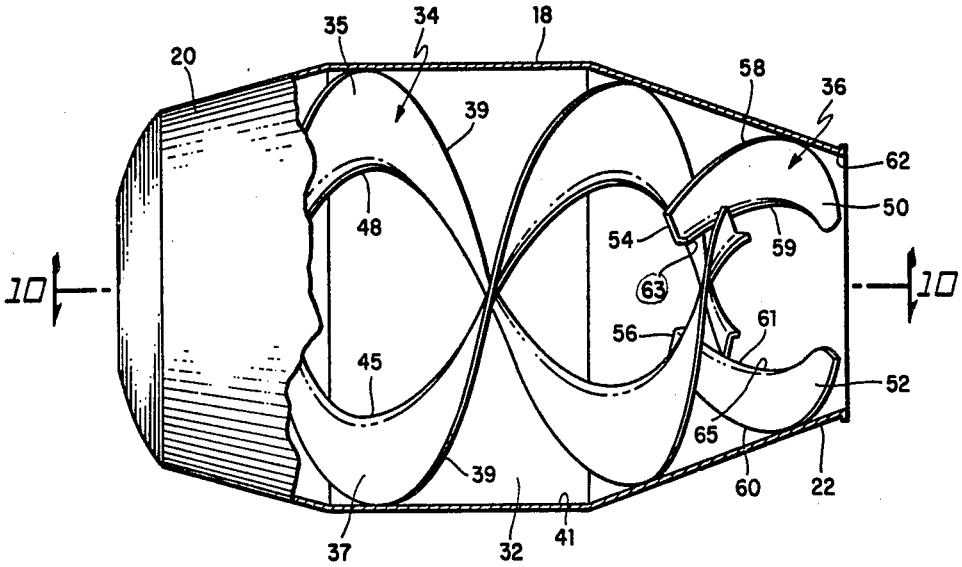
FIG. 9 is a detail view of the drum with the outer shell broken away to illustrate the interior groups of flights which make it possible to effect two-stage discharge; and, FIG. 10 is a section view taken on line 10—10 of FIG. 9.
Figure 10:
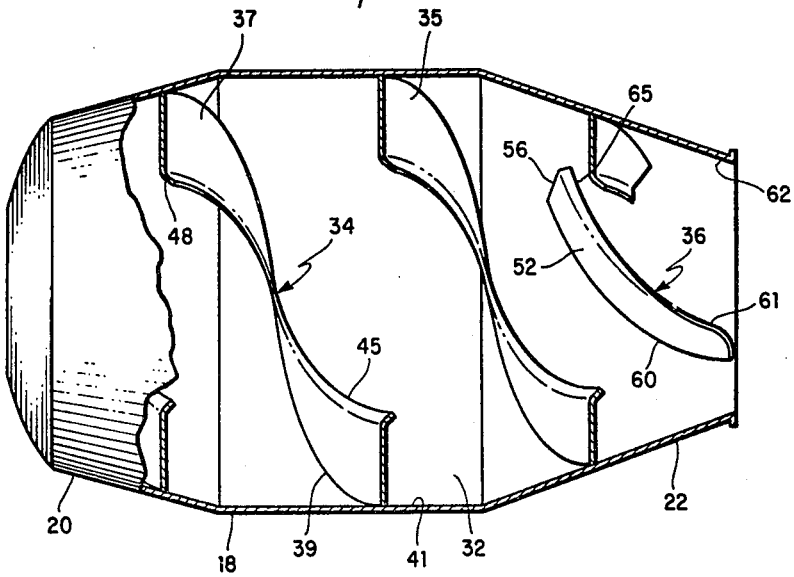

As shown in FIGS. 9 and 10, the interior 32 of the drum has two sets of paired flights 34,36. Flights 34 are identical spaced flights, sections 35,37 approximately 180° apart, extending helically from base 20 to forward end 22. The one edge 39 of each flight section 35,37 is welded or otherwise suitably secured to the interior surface 41 of the drum, and edge 45 extending toward the axis of rotation of the drum, has a turned-back flange 48.

Flight set 36 is arranged to overlap slightly with flight set 34, the set 36 of flights sections 50 and 52 commence at ends 54,56 in order to extend within the envelope of flight sections 35,37 and the edges 58,60 are likewise welded to the interior surface 41 of the drum and the free edges 59,61 are similarly turned back to form transverse flanges 63,65 in order to expedite the lifting and regular transferral of the concrete mixture toward the exit end 62 of the drum.

Figure 3:
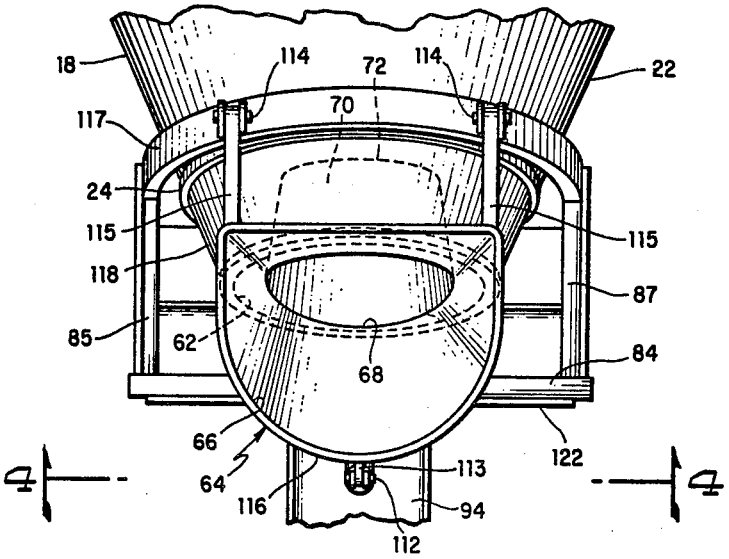
FIG. 3 is a top view at the discharge end of the drum, illustrating in fragmentary view the charge hopper in a lowered position.
Figure 5:
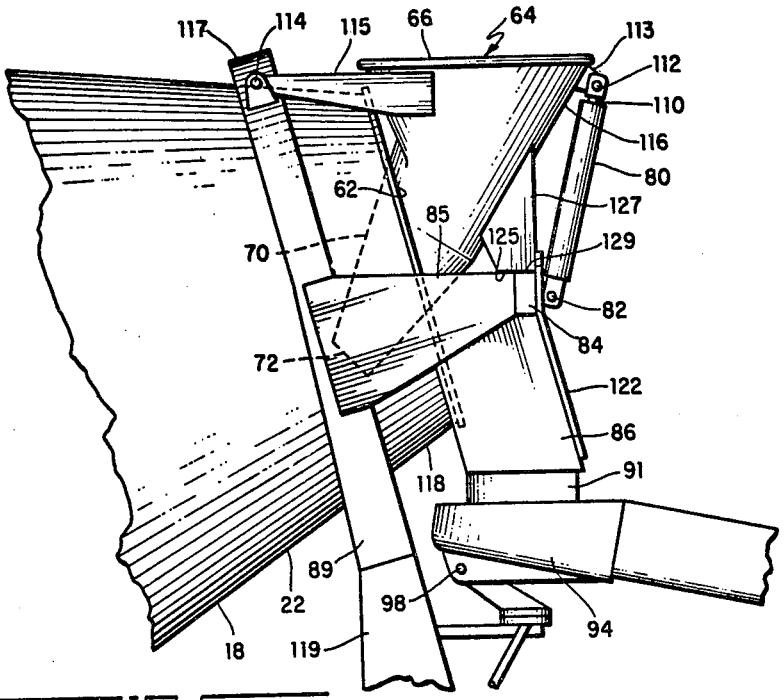
FIG. 5 is a detail view of the charge hopper in side elevation.
Figure 7:
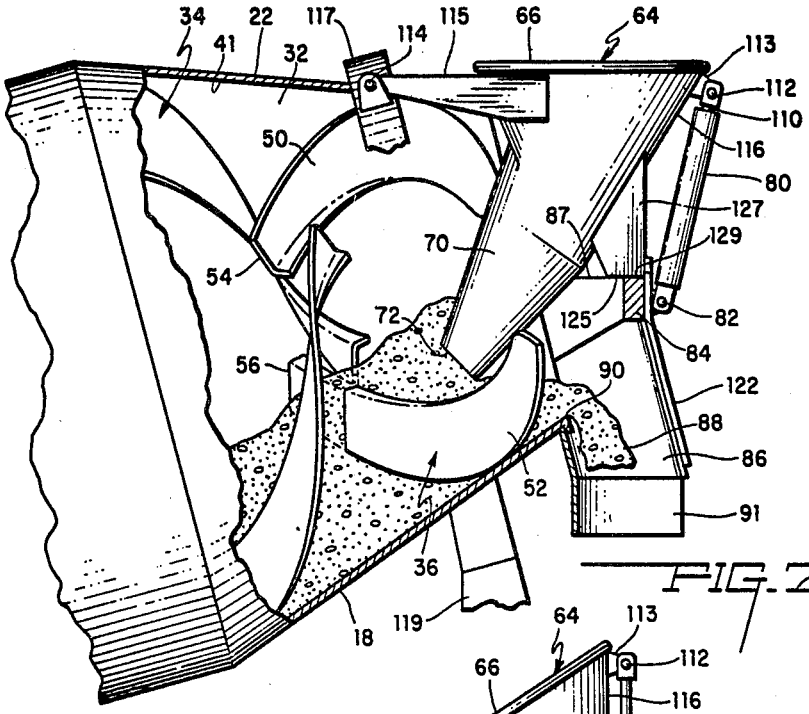
FIG. 7 is the same view as that of FIG. 5, but with a portion of the drum at the discharge end broken away to illustrate the combination of vanes which are welded, or secured, to the interior of the drum.

At exit end of the drum is a hopper 64 with an open or charging end 66 and a discharge end 68 (FIG. 3) which leads to a stub chute section 70 also with an open end 72 which extends within the bowl as indicated in FIGS. 3,5, and 7.

Figure 4:
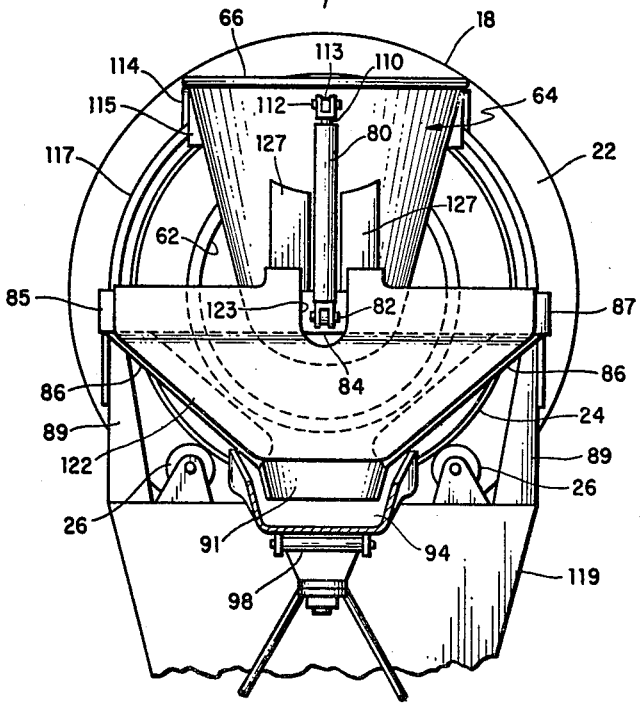
FIG. 4 is a rear view looking in the direction of the arrows 4—4 in FIG. 3, with the charge hopper still in its lowered position.
Figure 6:
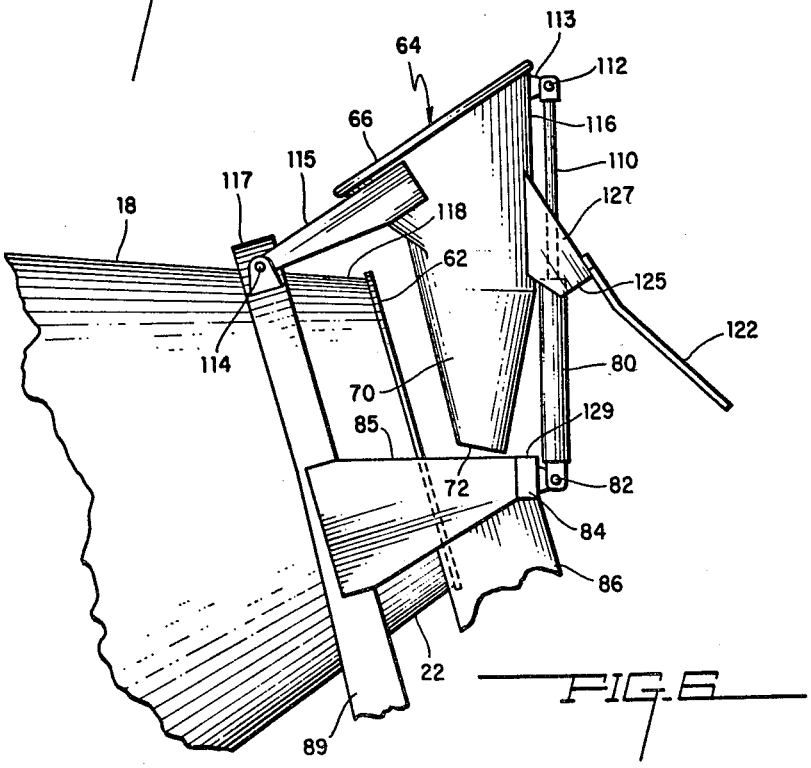
FIG. 6 is the same view as FIG. 5, but illustrating the charge hopper in a raised position.
Figure 8:
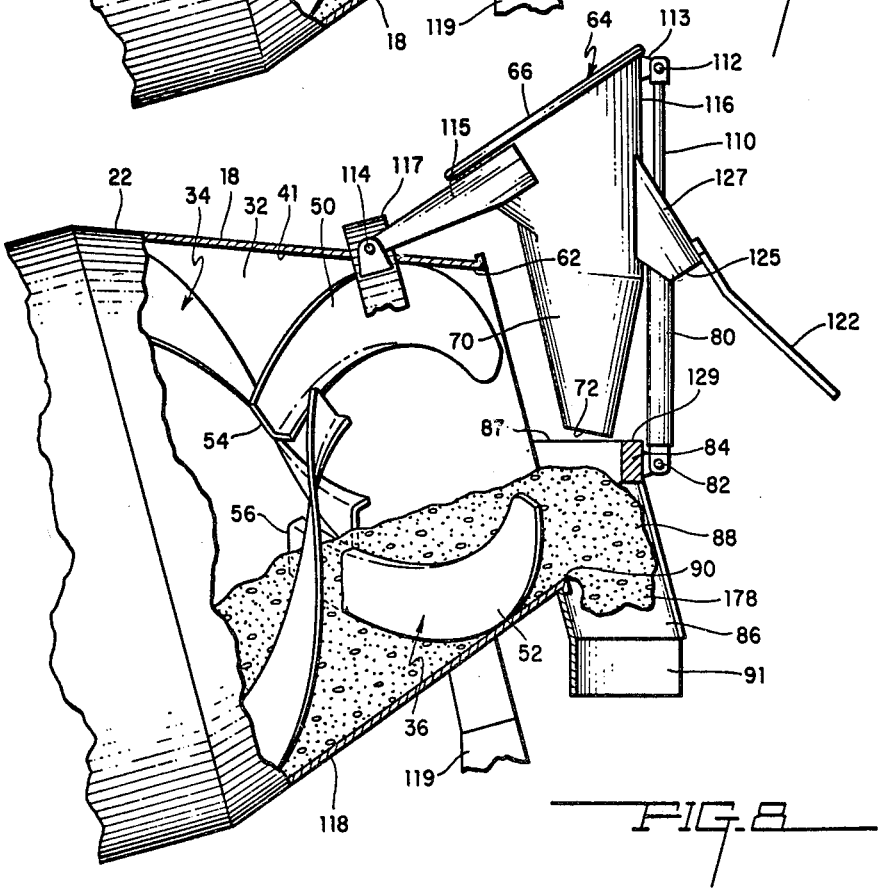
FIG. 8 is the same view as FIG. 7, but illustrating the charge hopper in a raised position and illustrating how the aggregate is dischargeable at a faster rate in the raised position of the chute and weir as compared with the discharge rate in FIG. 7.

That part of the stub chute 70 which is received within the drum, acts as a weir or dam tending to constrict the open end 62 of the drum and it can be either lowered to the normal position shown in FIGS. 5 and 7, or raised to the position shown in FIGS. 6 and 8 by means of a remotely operable power cylinder 80 having a pivot connection 82 with brace 84 which is supported by arms 85,87 projecting outwardly from the truck and are secured to stanchion 89 (FIGS. 3,4,5, in noninterfering relationship with the discharge end 62 of the drum so as to obstruct the emerging concrete mix during the pour.

At each of the lateral sides of the open end 62 of the drum is downwardly tapering apron section 86 leading to a depending funnel 91 so that as the pour 88 passes over the lower lip 90 of end 62 (FIG. 7) it passes into the downwardly tapering apron 86 and into funnel 91. A chute section 94 receiving the pour from funnel 91 is pivoted at 98 by a power cylinder 100. This cylinder 100 is operatively connected to chute section 94 at 102 and to the vehicle frame 14 at 104 to effect angular movement of the chute and thereby directing where the pour occurs. An extendable second chute section 106 folded back to the transit position in FIG. 1 and during the pour is pivoted 180° about hinge 108 to extend the chute whereby the pour point can occur farther away from the truck.

Hopper 64 is raisable from the position shown in FIGS. 5,7 to that shown in FIGS. 6,8 when hydraulic or air pressure produces protractile movement of piston rod 110 pivotally connected at 112 to a flange 113 on the outer edge of the hopper 64, causing the hopper, which is mounted on hinge connections 114 through arms 115 to be raised vertically upwardly. The hinge connection 114 for the arms 115 is mounted on a semicircular brace 117 (FIG. 3) which is further mounted on stanchion 89 secured to the frame 14. When the hopper is raised, it removes the stub chute section 70 from within the frustoconical end section 118 of the drum 18 at the discharge end, thereby allowing free and unimpeded outflow of the pour 88 at the open end 62.

There is also attached to the hopper 64 a splash barrier 122 with a cutout 123 (FIG. 4) which serves as an additional guard against accidental splash of the aggregate from the discharge end of the bowl during transit. It frequently happens, particularly with high orders of slump, that some of such aggregate will be jostled out of the drum during transit; the barrier 122 prevents this. There is avoided not only a loss of the valuable mix, but also an unnecessary contamination of the highway along the transit route from the mixer plant to the site of the pour.

During transit the hopper is lowered to the positions of FIGS. 3, 4, 5, and 7, during which the ends 125 of a pair of box-shaped plates 127 welded to the exterior of the hopper engage stop surfaces 128 (FIGS. 5–8) of brace 84 to support the hopper weight on the brace 84. The operator has available to him a control panel 132 with control levers 134,136 and 138 which control connections to the drum rotation motor (not shown), and hydraulic cylinders 80,100. It is thus possible to control the discharge rate, the degree of lift of the hopper 64, and the swinging action of the chute sections 94,106 to determine the location of the pour.

Further details of the discharge hopper, construction and placement, are contained in co-pending application Ser. No. 794,750 filed May 9, 1977, titled "TRANSIT CONCRETE MIXER WITH DISPLACEABLE CHARGING HOPPER", assigned to the same assignee as the present application.

OPERATION

In operation, the hopper 64 is lowered to the position shown in FIGS. 5,7 during charging of concrete mix to the interior of drum 18.

During transit, the drum 18 is rotated in a direction such that the flights 34,36 will tend to carry the aggregate to the lowermost portion of the drum, that is, the base of the bowl, where the aggregate is mixed or turned over so that its slump value will remain substantially the same. When the site of the pour is reached, considering the case where there is a very low-slump, high-stiffness aggregate, the power cylinder 80 is actuated to raise the hopper 64 from the position shown in FIGS. 5,7 to that shown in FIGS. 6,8, thus offering no obstruction to the outflow of aggregate through the open end 62 of the drum 18. The drum 18 is then counterrotated at a preferred speed, and the first set of flights 35,37 will carry the aggregate up to the approximate end of these flight sections, which approaches the open end of the bowl. At that point, however, the angle of attack of the blades is insufficient to carry the aggregate forwardly so the aggregate tends to fall into the overlapping sections 54,56 of flights 50,52 which have a much flatter angle of attack. At this point the stiffer aggregate is carried forwardly by flights 50,52 in a more efficient and effective manner, causing the aggregate to emerge at the open end 62 and over the lip 90 as flow 178 (FIG. 8).

All portions of the exit opening are available to the emerging aggregate because of the raised position of the hopper 64 since end 72 of the stub chute 70 which would otherwise act as a weir and obstruction, is raised out of interfering relationship with the aggregate.

In the event that there is a high order of slump of aggregate, the hopper 64 is lowered to the position shown in FIGS. 5,7 by operation of the lift cylinder 80, causing the hopper and attached stub chute 70 to project within the opening 62 of the drum 18 and thereby offering obstruction to the outflow of aggregate indicated by reference numeral 88 in FIG. 7.

In this position, the ends 125 of the box-shaped plates 127 engage surface 129 of brace 84 to support the hopper in this position. Also, the shield 122 confines the flow of aggregate, preventing rapid surging in outflow.

Because of the relationship of the two sets of flight 34,36 and their adaptation to discharge a very stiff aggregate of low slump value, the same sets of flights would produce for a given speed of rotation of the drum a too rapid discharge of a more fluid aggregate having a high water content and a high order of slump value. In this case, for the same rate of rotation of the drum, excessive discharge rate for the aggregate is checked by the stub chute 70 which serves as a weir and, together with the shield 122, and proper control of the rate of counterrotation of the drum, there is produced the preferred rate of discharge of aggregate, as indicated by reference numeral 88 in FIG. 7.

The combination of sets of flights 34,36 creates a two-stage discharge. The first flight set 34 picks up and advances the low-order slump toward the discharge end where it is then "picked-up" by the flatter angle of attack flight set 36. This makes it possible to employ the same transit concrete mixer unit for so-called "pavement" type aggregates in which the slump is very low, and is discharged without the aid of forms. In many machines today which are used for continuous pouring of curbing, there is a need for a very stiff, self-supporting concrete from the very beginning and without forms. A stiff mix is required, and the present invention is adapted for inter-cooperation of the transit mixer with that type of device now available and utilized for continuous manufacture of curbing. Likewise, the same machine, with adjustment of the weir or stub chute 70 and the baffle plate 122 the same mixer unit is equally adapted for high slump aggregates. All that is required is adjustment of hopper position from FIG. 8 to FIG. 7, or some intermediate position to throttle the outflow of aggregate by the stub chute 70. Another factor is slowing the rotation of the drum and continuing as before with the same set of flights.

The invention is equally useable for front discharge concrete mixer units as illustrated in FIG. 2. The only difference between the two units is that, instead of discharging to the rear of the truck unit, the aggregate is discharged from the bowl at a location which is vertically above the front of the cab and the pour is made in full view of the operator, who can remain within the cab and direct the chute from the cab, to the site of the pour, using the steerable front wheels of the truck and other controls having to do with controlling the length of the chute and its angular placement.

When the hopper 64 is raised, it is possible to clean the apparatus much more easily. While the hopper is lowered, it is not as convenient or practical to wash the aggregate off of the component parts of the hopper, chute, bowl, etc., as in the case of first raising the hopper and then directing a high pressure stream of water against the mixer components to wash off all aggregate between runs, and at the end of a working period. Thus, an important feature of the present invention is the ease with which the unit can be cleaned and more readily maintained in working order.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention and it is intended that such revisions and adaptations will be included within the scope of the following claims as equivalents of the invention.

What I claim is:

1. In a mobile concrete mixer unit, the combination comprising a bowl, means providing support for rotatable movement of said bowl, an access-and-discharge opening of said bowl through which concrete mixture is charged and discharged according to the direction of rotation of the bowl, a hopper positioned adjacent said opening to direct the entry of the concrete mixture into said opening, a stub chute extending from said hopper toward said opening to direct the inflow of concrete mixture to within said bowl when said stub chute and hopper are in a lowered position, support means for carrying said stub chute in a lowered position, fluid pressure actuated means for raising said stub chute and hopper from said lowered position to a second and elevated position whereby the bowl opening is unimpeded thereby, and two pairs of end-to-end flights within said bowl, each flight of a respective pair having a different slope and disposed one relative to the other with the pair of flights adjacent the discharge opening having a flatter angle of attack with the concrete mixture within said bowl whereby very stiff concrete mixture of low-orders slump are dischargeable with said hopper and stub chute in a raised unimpeding position and concrete mixture having slumps of higher value are dischargeable by a combination of the same flights with said hopper and stub chute in a lowered position effecting an obstruction to discharge by said flights to control the rate of flow from side discharge opening.

2. The concrete mixer unit in accordance with claim 1 including control means for remotely effecting raising and lowering of said hopper and stub chute relative to said discharge opening of said bowl.

3. The apparatus in accordance with claim 1 including an extendable chute for effecting an inclined, elongated slide path for the concrete emerging from said bowl during discharge from the bowl to direct the flow of concrete mixture to the site of pour.

4. The concrete mixer in accordance with claim 1 in which counterrotation of said bowl directs its discharge toward the forward end of the concrete mixer unit in a two-stage discharge operation of the concrete mixer unit.

5. The concrete mixer unit in accordance with claim 1 in which the flow is directed from the lowermost portion of said bowl.

6. The concrete mixer unit in accordance with claim 1 in which the first of said pairs of flights includes a combination of 180° displaced flights commencing from the lower bowl portion and extending helically toward the open end of said drum, and the second pair of flights disposed at the discharge end of said drum is slightly overlapped with said first flights and having a flat angle of attack adapted to receive the concrete mixture as it is transferred from said lower flights and is thereafter advanced from the interior of the drum to the discharge end thereof, notwithstanding the variation of slump value of such mixture.

7. The concrete mixer unit in accordance with claim 6 in which the portions of said flights extending toward the axis of rotation of said drum are bent over to form flanges to facilitate the pick up and advancement of said mixture as it is moved from the base of the drum toward the discharge end thereof.

8. The apparatus in accordance with claim 1 including a pair of support arms secured at the upper end of said hopper and extending toward said bowl, brace means extending over said bowl and having pivot connections, one with each of said arms and forming hinges about which said hopper is rotated in a vertical plane, articulated connections between said hopper and said fluid pressure actuated means to effect pivotal movement of said hopper about said hinge means during raising and lowering movements thereof, and weir means also carried by said hopper and adapted for movement into and out of damming relation to the exiting mixture as such mixture is discharged through the open end of said drum.

* * * * *